US006740017B2

(12) United States Patent
Pino

(10) Patent No.: US 6,740,017 B2
(45) Date of Patent: May 25, 2004

(54) INDOOR WALKING WORKOUT FACILITY

(76) Inventor: Raul Pino, 153 7th St., Bethpage, NY (US) 11714

( * ) Notice: Subject to any disclaimer, the term of this patent is extended or adjusted under 35 U.S.C. 154(b) by 333 days.

(21) Appl. No.: 09/891,744

(22) Filed: Jun. 26, 2001

(65) Prior Publication Data

US 2003/0008756 A1 Jan. 9, 2003

(51) Int. Cl.[7] ..... A63B 71/00

(52) U.S. Cl. ..... 482/148; 482/35; 482/14; 472/62

(58) Field of Search ..... 482/148, 75, 14, 482/51, 907, 35–37; 273/357, 406; 272/1–3, 19; 472/62, 48, 57–94, 136, 116, 128, 137; 473/150, 157, 175, 169–174, 156, 158–160; 52/64–65, 173.1, 302.1

(56) References Cited

U.S. PATENT DOCUMENTS 5,026,060 A * 6/1991 Beeber ..... 273/176 F
5,033,013 A * 7/1991 Kato et al. ..... 364/561
5,203,566 A * 4/1993 Ricigliano ..... 273/176 E
5,219,316 A * 6/1993 Huffman ..... 472/62
5,419,561 A * 5/1995 Weber ..... 273/176 AB
5,482,278 A * 1/1996 Hill et al. ..... 273/176
6,079,161 A * 6/2000 Tomioka et al. ..... 52/1
6,174,242 B1 * 1/2001 Briggs et al. ..... 472/136
6,425,825 B1 * 7/2002 Sitrick ..... 463/31
6,511,382 B1 * 1/2003 Ochi ..... 472/134
6,540,673 B2 * 4/2003 Gopinathan et al. ..... 600/300

* cited by examiner

*Primary Examiner*—Nicholas D. Lucchesi
*Assistant Examiner*—L. Amerson
(74) *Attorney, Agent, or Firm*—Michael I Kroll

(57) ABSTRACT

An indoor walking workout facility has multiple pathways traversing several rooms, with elevated passageways accessed by elevated paths. The path sections are movable and re-configurable. Several locations along the paths are equipped with scenery, scenic images, sounds, climates and smells that complement a theme for the particular location, such as a mountain walk. The scenic images are displayed on available surfaces, such as walls and ceilings, in a manner tending to surround the walker. Intertwined with the thematic locations are bridges, tunnels, steps, inclines, rope ladders, simulated rock and hill climbs, and the like, that provide varying levels of exertion. Walker care stations are interspersed along the paths for rest and determining blood pressure, heart rate, temperature, calories burned, miles walked, and other information related to the walking activity.

81 Claims, 9 Drawing Sheets

INDOOR WALKING WORKOUT FACILITY

BACKGROUND OF THE INVENTION

1. Field of the Invention

The present invention relates generally to work out facilities and, more specifically, to theme-based physical fitness facilities.

2. Description of the Prior Art

There are numerous facilities providing a place for people to exercise. While these exercise facilities may be suitable for the purposes for which they where designed, they would not be as suitable for the purposes of the present invention as heretofore described. It is thus desirable to provide an environmentally controlled walking workout facility that allows a user to walk along paths that provide varying degrees of intensity according to slopes, steps, ladders etc. Physical information kiosks are placed periodically along the paths to provide the walker with replenishing fluids and also monitors their vital signs to insure that the workout is adequate to meet the individuals personal goals while not putting the exerciser at risk from over exertion. It is further desirable to provide a walking workout facility that simulates differing terrain and scenery, which could be changed easily and frequently through the use of projecting images onto the walls.

SUMMARY OF THE PRESENT INVENTION

A primary object of the present invention is to provide an indoor walking workout facility that would allow a person to walk safely and comfortably regardless of the weather conditions.

Another object of the present invention is to provide an indoor walking workout facility wherein an air filtration system removes pollutants and toxins from the air introduced into the walking environment thereby maximizing the aerobic benefits of the exercise.

Yet another object of the present invention is to provide an indoor walking workout facility with different paths offering varying levels of intensity depending on the obstacles and challenges provided such as inclines, steps, rope ladders, rock-climbing walls, etc.

Still yet another object of the present invention is to provide an indoor walking workout facility in as natural a setting as possible including living and ornamental foliage, ponds, rocks and so forth.

Yet another object of the present invention is to provide an indoor walking workout facility utilizing projections of digital images on the walls to transform an area into a visually dazzling scene that would, for example, allow a walker to stroll the flat terrain of the Mojave desert then climb the hilly landscape of the Himalayan mountains and finish the workout with a walk through the rain forest.

Still another object of the present invention is to provide an indoor walking workout facility that has physical information units placed intermittently along the paths to monitor the walker's vital signs and rate of progress from one unit to another.

Additional objects of the present invention will appear as the description proceeds.

The present invention overcomes the shortcomings of the prior art by providing a safe, healthy, climate-controlled environment that can easily be manipulated both physically and visually to allow the user to change the workout and scenery according to their needs and desires.

The present invention, an indoor walking workout facility, is a unique and innovative type of work out facility. Walking workout is a system of walking paths, surrounded by scenic views, divided into numerous paths, bridges, tunnels, underpasses, overpasses, and trails that cross and meander throughout one another.

The scenic views are projected wall images of mountains, forests, beaches, waterfalls, deserts, historical and prehistorical sites, cities, landmarks, with an unlimited source of scenery.

Throughout the walking path, rest areas are available for those who need or want to spend relaxation time near a lake or a waterfall, or find a quite place for meditation. Countless areas along the pathways provide not only physical information but also miles walked, calories burned, heart rate, improvements walker can make and other prevalent information the walker may access.

The main walking path is primarily flat, with little or no strain for any walker. Other paths and trails exist to provide walkers with workout difficulty by using inclines, slopes, steps, rock-climbing walls etc.

The surrounding terrain will be similar to the projected views and actual terrain, including temperature and smell. Walking workout gives an abundant combination of walking and climbing, allowing any walking enthusiast to create a favorite path. This eliminates workout doldrums, and promotes exercise, leading to good health for adults of all ages. Among the scenery, actual displays will exist, bringing added dimension to the flat wall imagery. Rain forests, large aquariums with exotic marine life, deserts with cactus, animals from select regions, are just a few of the unlimited ideas for actual displays. These areas may be larger than any one section on the pathway system.

Additional display areas will be created to reflect the current seasons, holidays and current events.

These changeable displays would have short life spans, monthly, weekly, and quarterly providing the walker with constant scenic variation, and provoking interest in returning to the facility.

My invention provides an indoor walking workout system, comprising: a path adapted to be followed throughout the system; scenery positioned along the path at selected locations, the scenery being viewable from the path; display surfaces along the path at selected locations, the display surfaces being viewable from the path; and scenic images displayed on the display surfaces.

In another embodiment, the system further comprises a walker care station.

In another embodiment, the walker care station comprises a physical information device.

In another embodiment, the physical information device measures the walker's heart rate.

In another embodiment, the physical information device measures the walker's temperature.

In another embodiment, the physical information device measures the walker's blood pressure.

In another embodiment, the physical information device measures the walker's weight.

In another embodiment, the physical information device measures the walker's calories burned.

In another embodiment, the walker care station comprises a walker information device.

In another embodiment, the walker information device provides the total distance the walker has walked.

In another embodiment, the walker information device provides the walker's average walking speed.

In another embodiment, the walker information device provides a comparison of the walker's current performance to the walker's prior walking performance.

In another embodiment, the walker information device provides a comparison of the walker's current performance to expected walking performance based on statistical norms.

In another embodiment, the walker information device provides information to the walker as to improvement of the walker's walking performance.

In another embodiment, the walker care station comprises a seating device.

In another embodiment, the walker care station comprises a reclining device.

In another embodiment, the walker care station comprises a beverage supply device.

In another embodiment, the walker care station comprises a beverage supply system.

In another embodiment, at least one location on the the path is positioned with respect to the scenery and the scenic images such that the walker's view from the location is limited to the path, the scenery and the scenic images.

In another embodiment, the system further comprises at least two partitioned areas.

In another embodiment, the areas are connected by walking passageways.

In another embodiment, the path further comprises elevated sections, and the passageways are elevated, the elevated passageways being accessed by the elevated path sections.

In another embodiment, at least two of the areas are partitioned by the display surfaces.

In another embodiment, the system comprises an environmental control system.

In another embodiment, the environmental control system further comprises an air filtration system.

In another embodiment, the environmental control system further comprises an odor-inducing system for at least one path location, the odor-inducing system providing smells that complement the theme of the scenery and scenic images viewable from the at least one path location.

In another embodiment, the environmental control system further comprises a temperature adjustment system for at least one path location, the temperature adjustment system providing temperatures that complement the theme of the scenery and scenic images viewable from the at least one path location.

In another embodiment, the environmental control system further comprises a sound-inducing system for at least one path location, the sound-inducing system providing temperatures that complement the theme of the scenery and scenic images viewable from the at least one path location.

In another embodiment, the scenic images include at least one image in motion.

In another embodiment, the scenic images include at least one fixed image.

In another embodiment, the scenic images include at least one digital image.

In another embodiment, the path further comprises movable path sections.

In another embodiment, the path further comprises at least one bridge.

In another embodiment, the path further comprises at least one tunnel.

In another embodiment, the path further comprises at least one incline.

In another embodiment, the path further comprises at least one decline.

In another embodiment, the path further comprises at least one set of steps.

In another embodiment, the path further comprises at least one slope.

In another embodiment, the path further comprises at least one rope ladder climb.

In another embodiment, the path further comprises at least one simulated rock wall climb.

In another embodiment, the path further comprises at least one simulated hill climb.

In another embodiment, the path further comprises at least two paths.

In another embodiment, each of the at least two paths further comprise indicia communicating the level of exertion required to complete the path.

In another embodiment, the path includes indicia communicating the level of exertion required to complete all or a portion of the path.

In another embodiment, the scenery is at least partially real.

In another embodiment, the scenery is at least partially artificial.

In another embodiment, the system comprises a ceiling.

In another embodiment, the ceiling is transparent.

In another embodiment, at least one of the display surfaces is a ceiling.

In another embodiment, the scenery further comprises at least one water pool.

In another embodiment, the scenery further comprises at least one water pond.

In another embodiment, the scenery further comprises at least one tree.

In another embodiment, the scenery further comprises at least one shrub.

In another embodiment, the scenery further comprises at least one plant.

In another embodiment, the scenery further comprises at least one rock.

In another embodiment, the scenery further comprises at least one grassy area.

In another embodiment, the scenery further comprises at least one desert area.

In another embodiment, the scenery further comprises at least one beach area.

In another embodiment, the scenery further comprises at least one cactus.

In another embodiment, the scenery further comprises at least one recreated historical site.

In another embodiment, the scenery further comprises at least one recreated pre-historical site.

In another embodiment, the scenery further comprises at least one aquarium.

In another embodiment, the scenery further comprises at least one rain forest area.

In another embodiment, the scenery further comprises at least one area having a holiday theme.

In another embodiment, the scenery further comprises at least one area having a seasonal theme.

In another embodiment, the scenery further comprises at least one area having a current events theme.

In another embodiment, the scenery further comprises at least one area having a theme depicting a city.

My invention provides an indoor walking workout system, comprising: a path adapted to be followed throughout the system; and means for thematically characterizing a location on the path.

In another embodiment, the means for thematically charaterizing a location on the path further comprises: scenery positioned along the path at selected locations, the scenery being viewable from the path; and means for displaying scenic images on display surfaces along the path at selected locations, the display surfaces being viewable from the path.

In another embodiment, the system comprises means for providing walker care at one or more locations along the path.

In another embodiment, the means for providing walker care comprises means for providing physical information about the walker.

In another embodiment, the means for providing walker care comprises a walker information device.

In another embodiment, the means for providing walker care comprises means for walker seating.

In another embodiment, the means for providing walker care comprises means for walker reclining.

In another embodiment, the means for providing walker care comprises means for supplying a beverage to the walker.

In another embodiment, the system further comprises means for partitioning the system into at least two areas.

In another embodiment, the areas are connected by walking passageways.

In another embodiment, at least one of the passageways is elevated, and further comprising means for providing access to the elevated passageways.

In another embodiment, the system comprises means for controlling the environment along the path.

In another embodiment, the environmental control system further comprises means for filtering the air.

In another embodiment, the environmental control system further comprises means for inducing an odor for at least one path location, the odors complementing the theme of the scenery and scenic images viewable from the at least one path location.

In another embodiment, the environmental control system further comprises means for adjusting the temperature for at least one path location, the temperature complementing the theme of the scenery and scenic images viewable from the at least one path location.

In another embodiment, the environmental control system further comprises means for inducing a sound for at least one path location, the sound complementing the theme of the scenery and scenic images viewable from the at least one path location.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a perspective view of the present invention in use. Shown is a female walking along a path in a walking workout facility. She feels safe although she is walking by herself since she is in a secure building and the weather outside doesn't effect the duration or intensity of her workout. The air is filtered and the walker is not subject to the pollutants and toxins that would be taken into the body during increased cardiovascular activity outdoors.

FIG. 2 is an isometric view of the present invention in use. Shown is a person walking along a path. Various inclines and steps are incorporated within certain pathways to increase the intensity of the workout. Physical information units are spaced apart and allow an exerciser to monitor his or her vital signs. The facility is segmented into several sections and allows for digital projections of various scenes to vary from section to section.

FIG. 3 is a top view of the present invention showing the layout of the walking paths in relation to the various sections and the various inclines and steps incorporated within certain pathways to increase the intensity of the workout. Physical information units are spaced apart and allow an exerciser to monitor his or her vital signs. The facility is segmented into several sections and allows for digital projections of various scenes to vary from section to section.

FIG. 4 is a perspective view of the present invention in use. Shown is a person walking into a rest area section of the walking workout facility. This section has a view of a mountainous region displayed by projection onto the walls. A physical information unit is located near the bench.

FIG. 5 is a perspective view of the physical information unit of the present invention in use. Shown is a walker standing on a scale platform with her hands inserted into a biofeedback/progress monitoring recess in the physical information unit. Displays located on the top of the physical information unit provide data such as weight, heart rate, calories burned, miles walked during current workout, progress as opposed to previous workouts, and advise and tips to achieve your most effective workout.

DESCRIPTION OF THE REFERENCED NUMERALS

Figure 1:
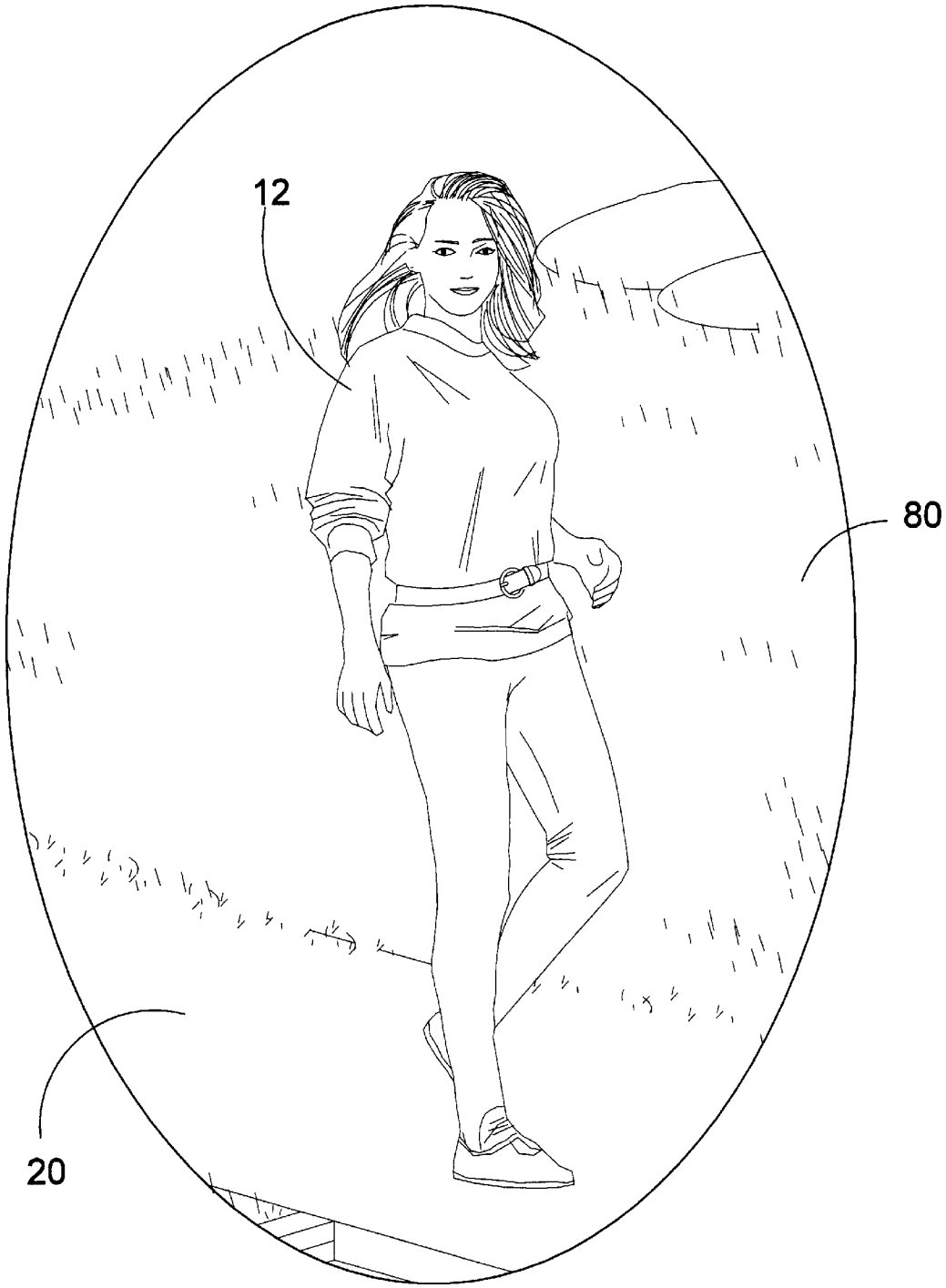

Turning now descriptively to the drawings, in which similar reference characters denote similar elements throughout the several views, the figures illustrate the embodiments of the indoor walking workout facility of the present invention. With regard to the reference numerals used, the following numbering is used throughout the various drawing figures.

| | |
|---|---|
| 10 | indoor walking workout facility |
| 12 | walker |
| 20 | path |
| 22 | room |
| 24 | room |
| 26 | room |
| 28 | room |
| 30 | room |
| 32 | room |
| 34 | room |
| 36 | room |
| 38 | room |
| 40 | bridge |
| 42 | tunnel |
| 44 | incline |
| 46 | decline |
| 48 | underpass |
| 50 | overpass |
| 52 | steps |
| 54 | slope |
| 56 | rock climb |
| 58 | rope ladder |
| 70 | pools |
| 72 | pond |
| 74 | tree |
| 76 | shrubs |
| 78 | plants |
| 80 | grass |
| 82 | rocks |
| 84 | desert |
| 86 | cactus |
| 90 | rest area |
| 92 | physical information station |
| 94 | bench |
| 100 | passageways |
| 102 | elevated paths |
| 104 | walls |
| 106 | projected scenic image |
| 108 | ceiling |

DETAILED DESCRIPTION OF THE PREFERRED EMBODIMENTS

Turning now descriptively to the drawings, in which similar reference characters denote similar elements throughout the several views, FIGS. 1–9 illustrate the indoor walking workout facility and system of the present invention, indicated generally by the numeral 10.

Figure 2:
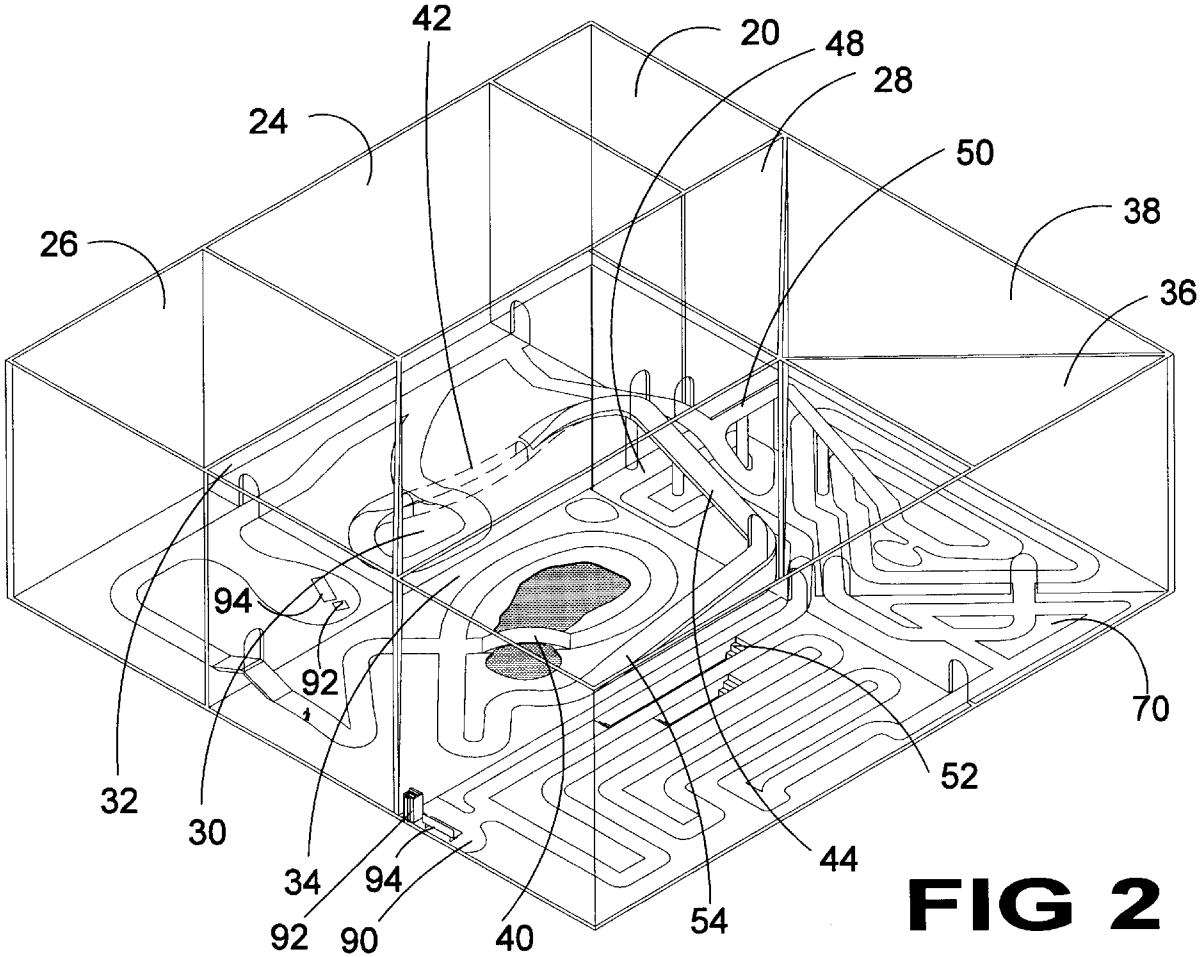
Figure 3:
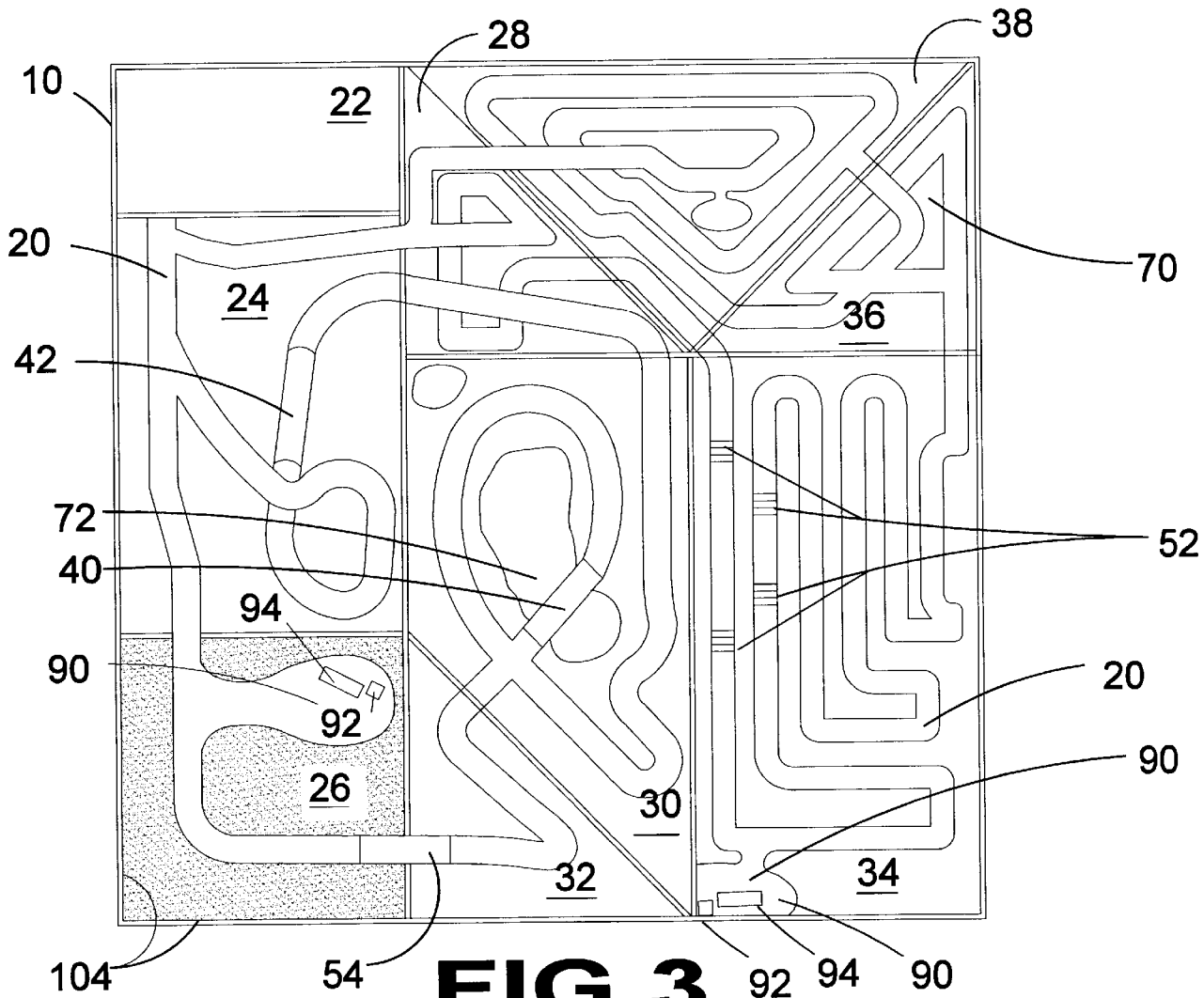

As shown in FIGS. 2–3, the walker 12 of FIG. 1 entering the facility 10 is provided with a walking path 20 that is strategically routed from a facility entry room 22 through seven additional rooms 24,26,28,30,32,34. As the path 20 proceeds throughout the facility 10, the path 20 divides to form other paths.

Along the path 20, the walker 12 will encounter a wide variety of bridges, such as the bridge 40 in room 30, tunnels, such as the tunnel 42 in room 24, inclines, such as the incline 44 in room 28, declines, such as the decline 46 in room 38, underpasses, such as the underpass 48 in room 28, overpasses, such as the overpass 50 in room 28, steps, such as the steps 52 in room 34, and slopes, such as the slope 54 in room 30. The invention also includes path interruptions or diversions for simulated rock wall 56 climbs, rope ladder 58 climbs, and hill climbs, as the walker 12 proceeds through various paths 20.

At various locations along the paths 20 in the facility 10, the walker 12 will be able to observe real and artificial scenery. Such scenery includes pools, such as the pool 70 in room 38, ponds, such as the pond 72 in room 30, trees, such as the tree 74 in FIG. 4, shrubs, such as the shrubs 76 in FIG. 4, plants, such as the plants 78 in FIG. 4 and FIG. 6, grasses, such as the grass 80 shown in FIG. 4, rocks, such as the rocks 82 in FIG. 4, desert areas, such as the desert areas 84 in FIGS. 6–9, cacti, such as the cactus 86 of FIG. 6.

Figure 4:
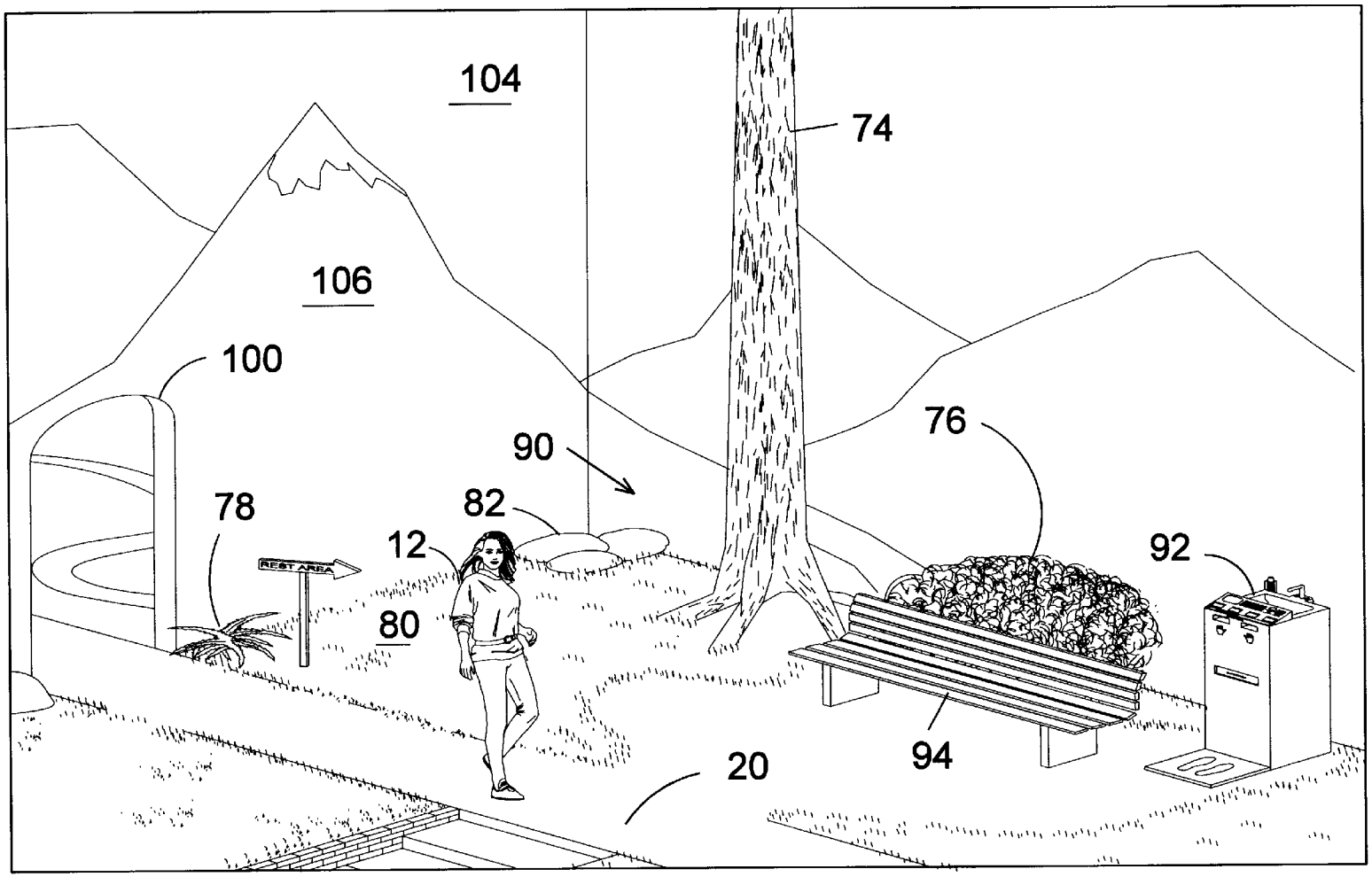
Figure 5:
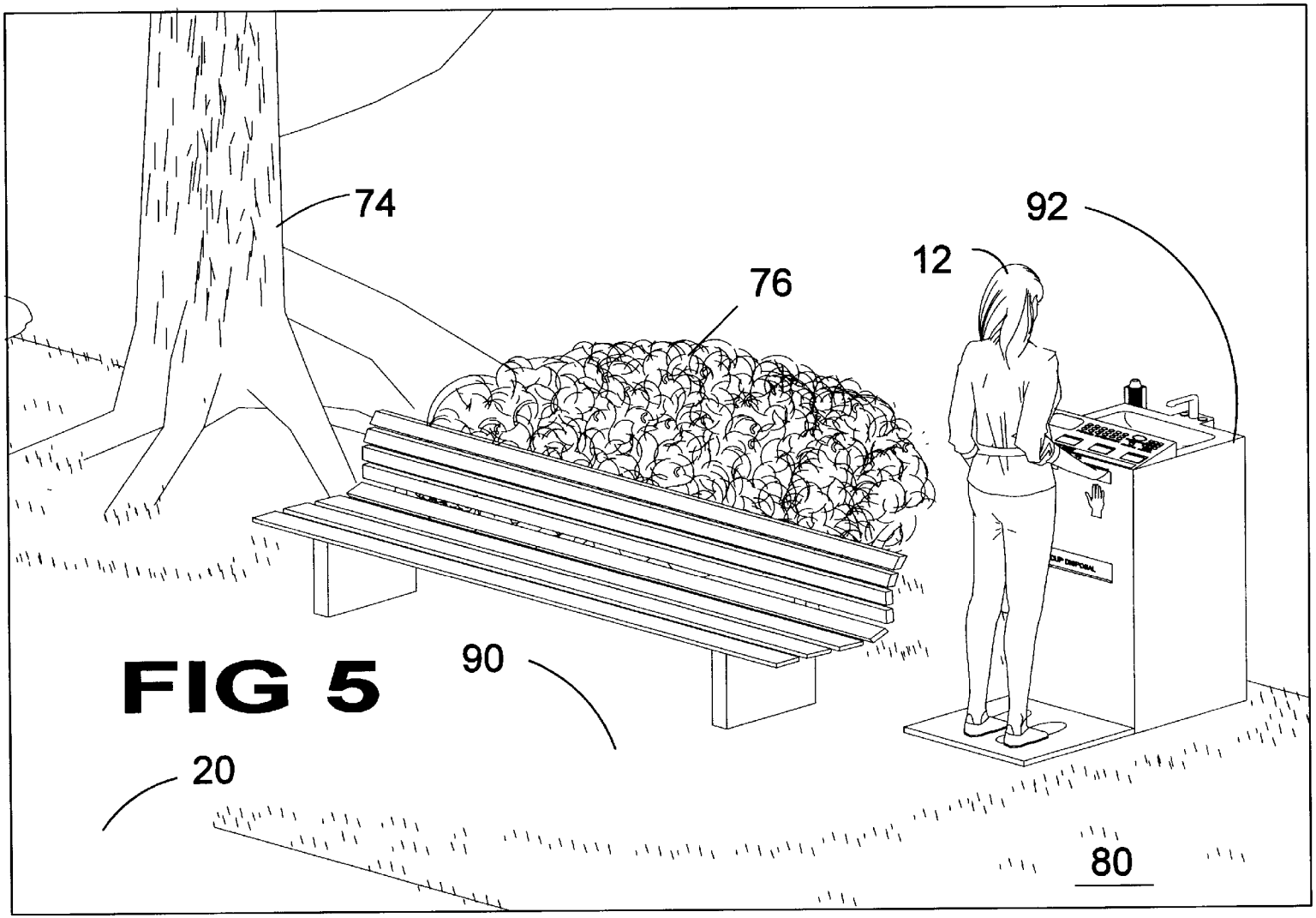
Figure 6:
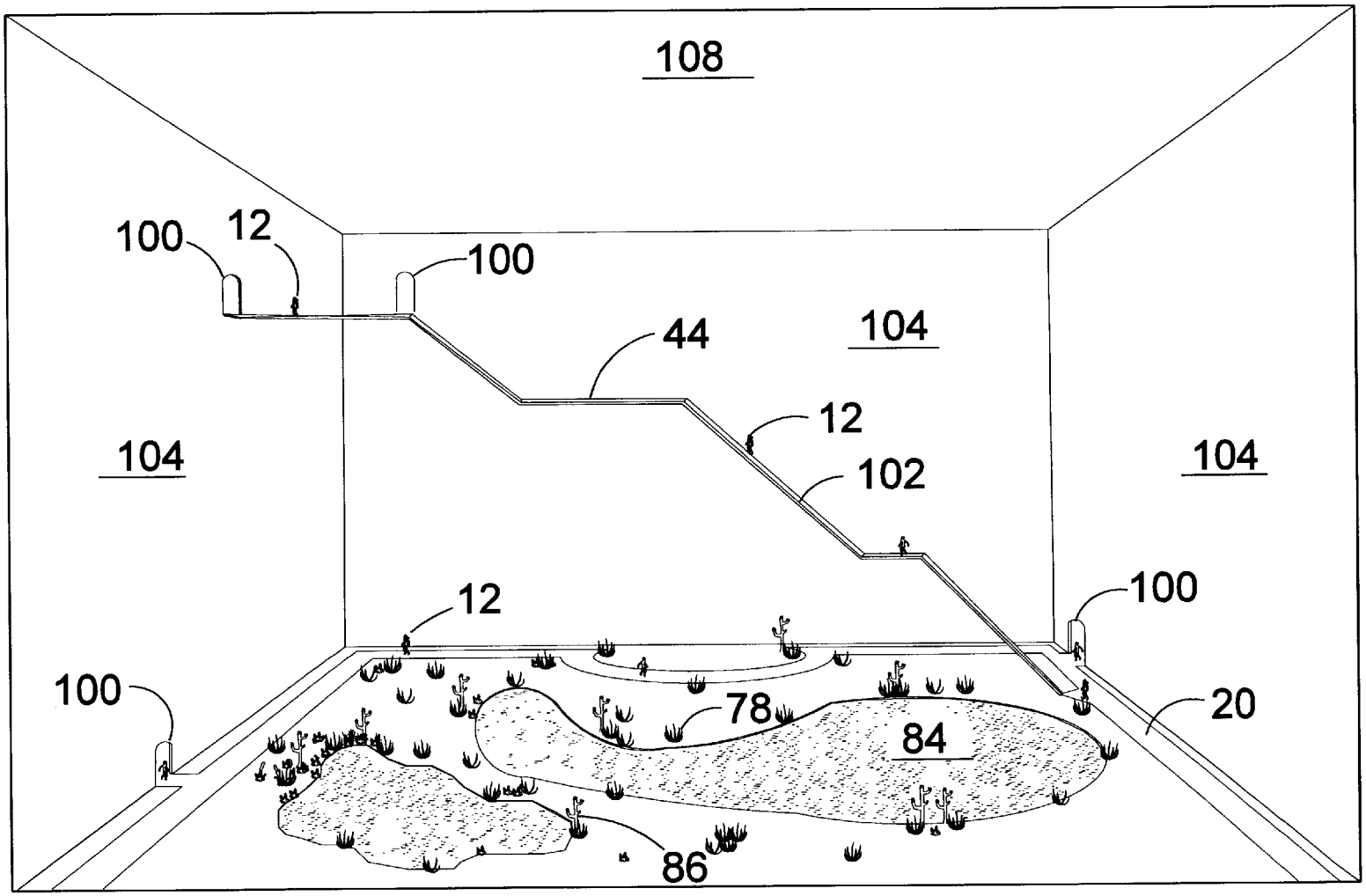
FIG. 6 is a perspective view of a room having a multilevel configuration. Pathways can be moved from one location to another and lead from one section to another and can be redirected into another path or room.
Figure 7:
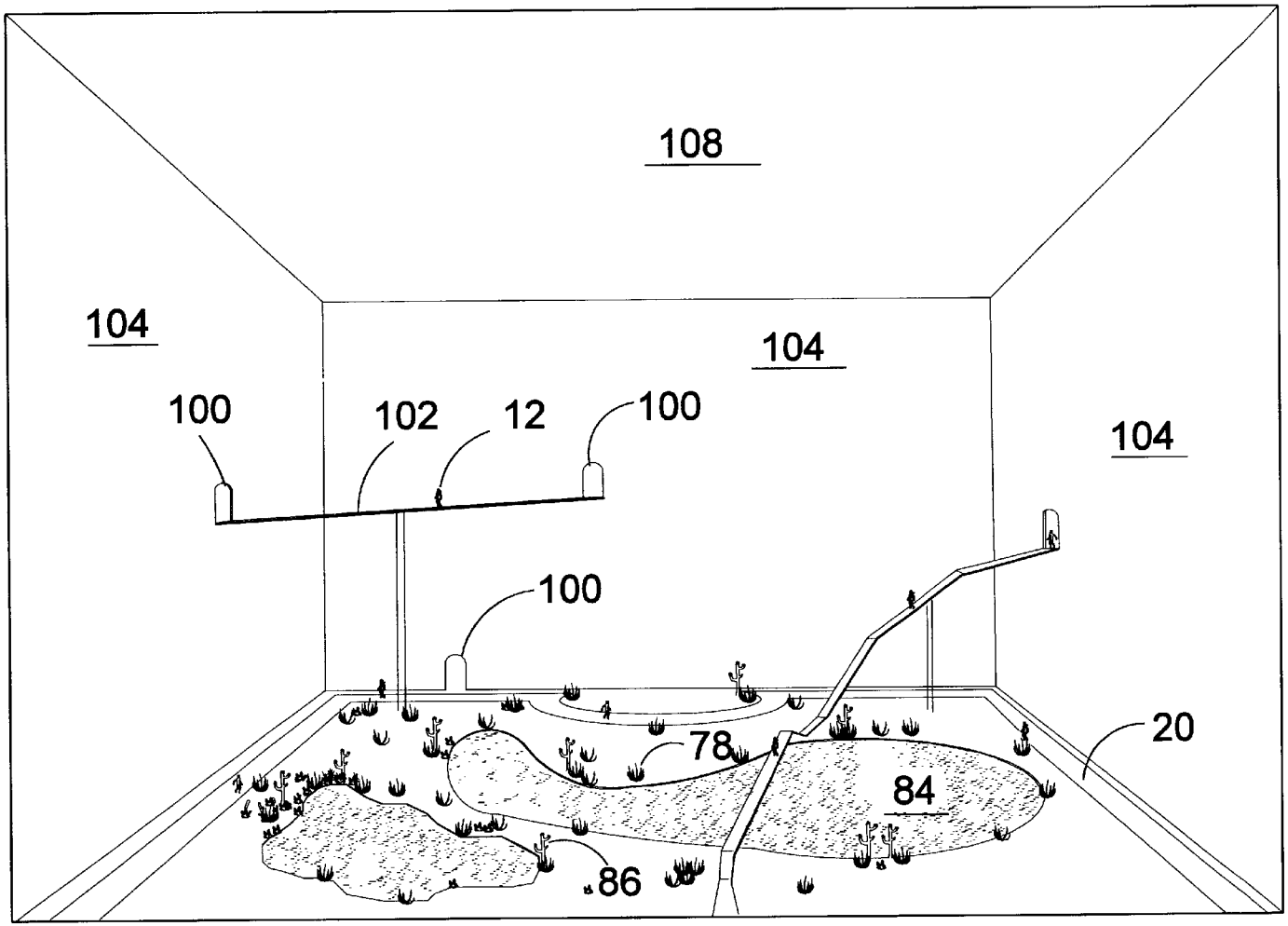
FIG. 7 is another perspective view of the room having a multilevel configuration.

As part of the care available for the walker 12 in the facility 10, I have provided walker care stations 90 are provided at various locations along the paths 20, as shown in FIGS. 4–5. Seating areas, such as the benches 94 in room 26 and room 24 are provided, as well as, open grassy areas 80 for reclining, as shown in FIG. 4. Other reclining devices such as hammocks are also provided. Beverage supply devices such as water fountains are also provided.

An important feature of the walker care station 90 is the physical information unit 92, which provides heart rate, blood pressure, weight, temperature, calories burned, and similar information for the walker 12, as the walker 12 completes the stage of his or her walk that terminated at the care station 90. As shown in FIG. 5 the walker 12 stands on a scale platform with her hands inserted into a biofeedback/progress monitoring recess in the physical information unit 92.

In addition to the physical information, the unit 92 provides information for the walker 12, such as the total distance walked, the average walking speed, a comparison of the walker's 12 current walking performance to the walker's 12 prior walking performance, as stored by the unit 92, and a comparison of the walker's 12 current performance to the expected walking performance based on statistical norms. General information and advice is also provided as to ways in which the walker 12 can improve his or her walking performance.

Figure 8:
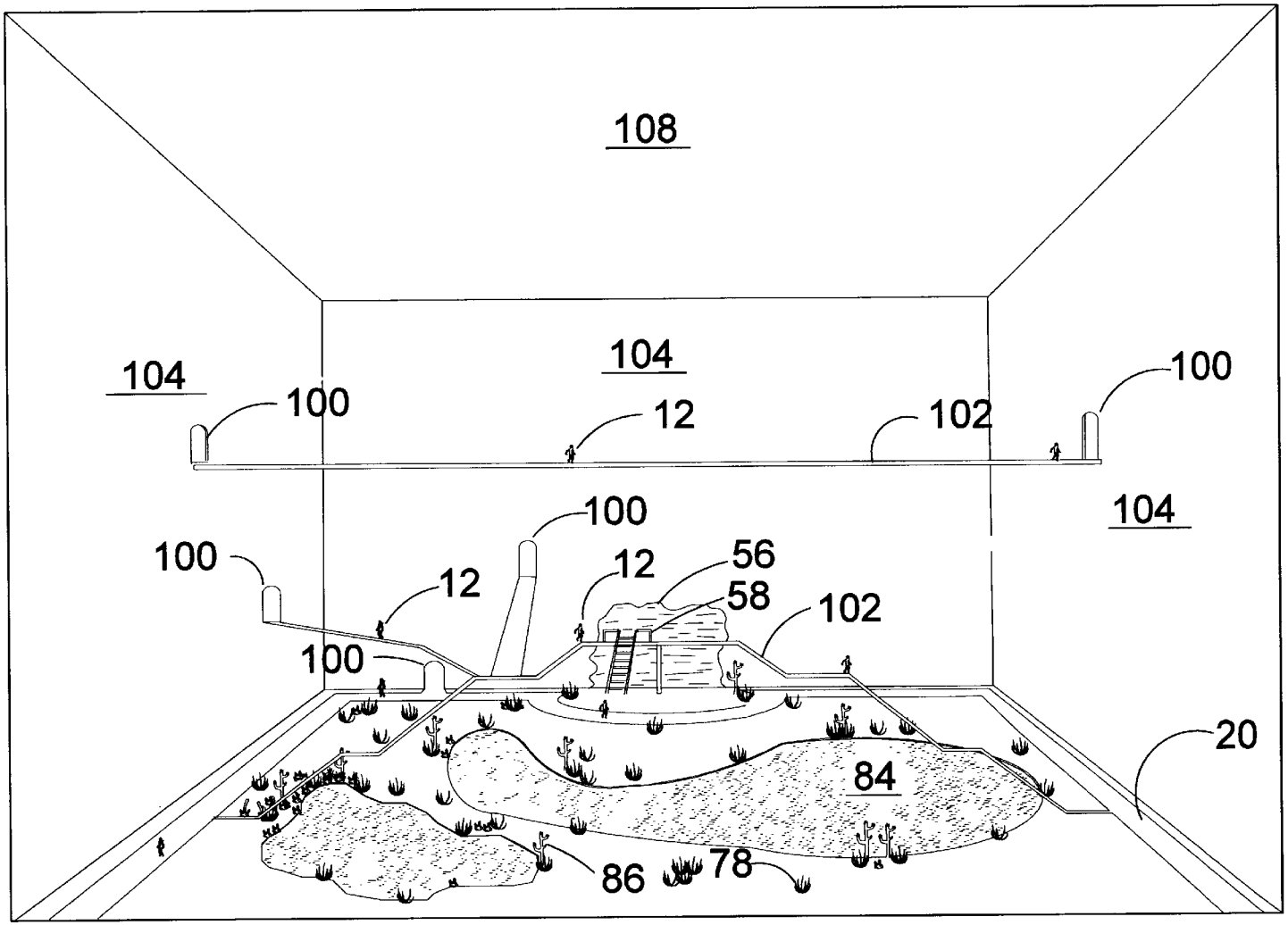
FIG. 8 is another perspective view of the room having a multilevel configuration.
Figure 9:
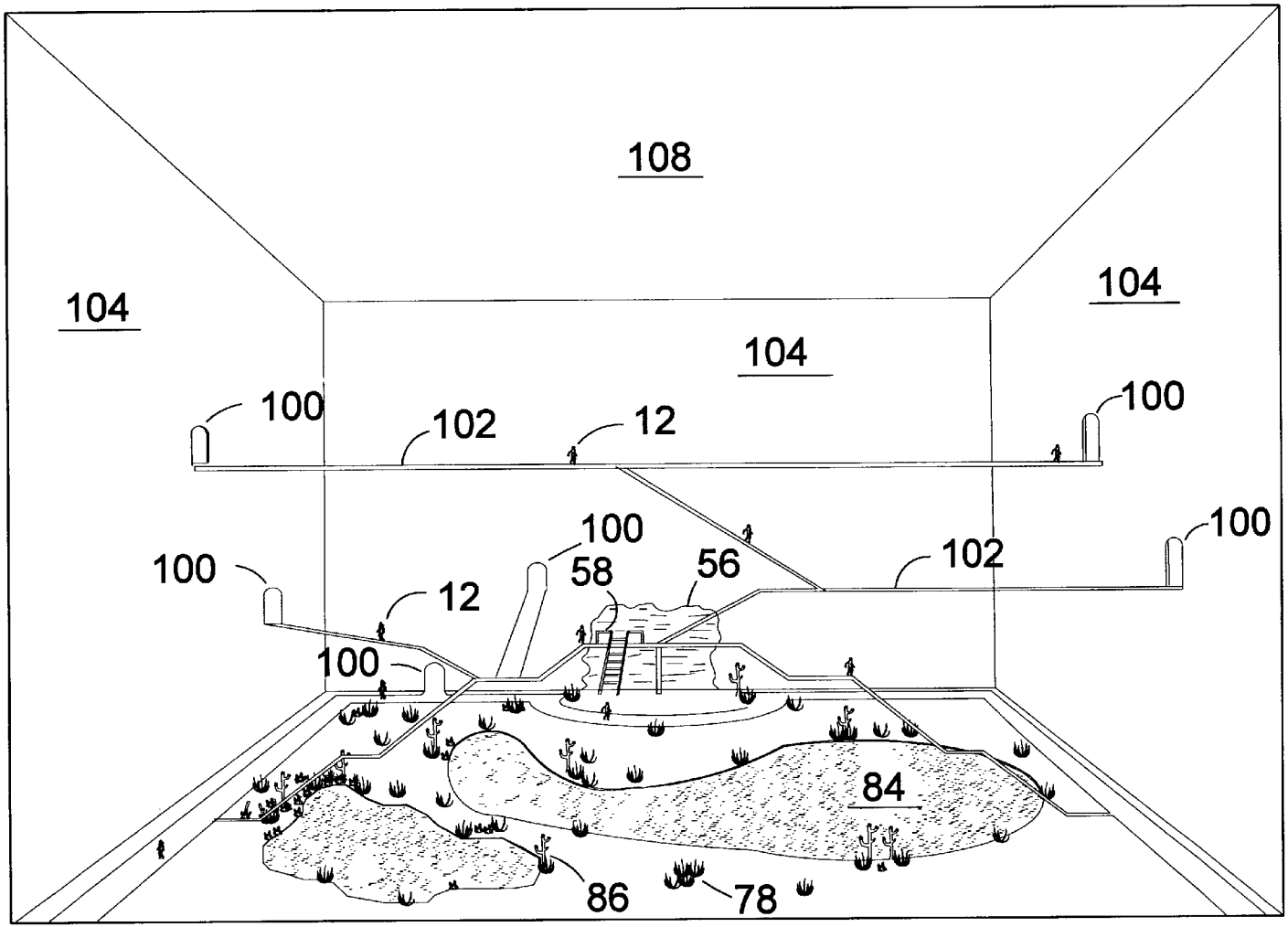
FIG. 9 is another perspective view of the room having a multilevel configuration.

A significant advantage of the facility 10 over traditional buildings is the passageways 100 between rooms 22,24,26,28,30,32,34,36,38, many of which are elevated to correspond with elevated path sections 100, as particularly shown in FIGS. 6–9. Because the path sections 100 are movable and re-configurable the path 20 through a particular room can vary on a regular basis to traverse different portions of a particular room. FIGS. 8–9 illustrate a room that has had the elevated path sections 102 reconfigured to add an additional view of the desert areas 84 and cacti 86.

The elevated paths 102 provide the ability to the create paths 102 with much steeper grades than are available in conventional buildings with floor-level doors and passageways. The exertion level required to walk such paths 102 can be adjusted as elevated passageways 100 at differing heights are chosen for particular elevated paths 102. Such flexibility allows even the most athletic walkers 12 to have a strenuous path available if desired.

In order to assist in the selection of the path 20,102 that will provide the optimum level of exertion for the individual walker 12, information is provided at the walker care stations 90, and indicia, such as alphanumeric characters, colored indicators, and small message panels are provided at various points of entry to the paths 20,102.

The facility 10 introduces various themes, and sub-themes, including themes such as nature, desert, beach, forest, mountains, historical, pre-historical, seasonal, holidays, and the like, at various locations along the different paths 20. A representative theme location is depicted in FIG. 4, i.e. a nature theme, with a mountain path sub-theme.

The walls 104 of the rooms 22,24,26,28,30,32,34,36,38, as well as, other surfaces provide excellent display surfaces for scenic images 106 that, along with appropriately chosen scenery, establish the theme at a particular location along the paths 20. These images 106 can be projected upon such surfaces 104 or can be broadcast through screens on such surfaces 104. The ceiling 108 can also be used as a display surface, and can be transparent to utilize existing sunlight when desired.

The invention provides for both still and motion images using all known media, such as photographic, digital, videographic, three-dimensional and the like.

When properly arranged the combined scenery and scenic images 106 result in the walker's 12 view in some locations being limited to the scenery, the path 20, and the scenic images 106, providing a complete visual perception in agreement with the theme or sub-theme.

To enhance the perceptory pleasure of the walker 12, the invention provides environmental control systems. For example, a typical air filtration system is unobtrusively configured behind display surfaces or within the scenery. When so provided it removes odors and particulate from the air that would be inconsistent with the location's theme and the walker's respiratory well being.

A typical sound-inducing system is also provided that introduces sounds to the location that complement the location's theme.

Similarly, a typical odor-inducing system introduces one or more odors to the location that will complement the location's theme.

A typical temperature adjustment system is also provided that establishes a temperature in the particular location that complements the location's theme. This system will also adjust the humidity in a similarly complementary fashion.

The multi-room aspect of the facility 10 provides the opportunity to establish and isolate numerous locations along the path 20 with varying themes that enhance the walker's 12 experience by removing the mundane aspect of the typical inner-city walk. The themes can be readily changed to keep the experience new for repeat participants. Because the path sections 20,102 can be re-routed, the operator can visually isolate particular areas within a single room from the path 20 as it lies in that room. The scenery, scenic images 104 and environmental control systems can then be changed in the isolated portion of the room, without completely removing the room from service.

When properly configured and equipped using the concepts, scenery, scenic images 104, and paths 20,102 described above, the walker 12 can enter through one or more public entrances such as room 22, and strike out on a path 20,102 that will soon branch and re-branch to paths 20,102 requiring varying levels of exertion, while enjoying a complete and refreshing perceptory experience in the various thematic locations.

Although certain scenery, scenic images, path configurations, and themes have been discussed, other path configurations and types of scenery and scenic images can also be used, all in accordance with the present invention, and as determined by the intended end use for the overall device 10, as will occur to those of skill in the art upon review of the present disclosure.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An indoor walking workout system, comprising:

a path adapted to be followed throughout the system;

scenery positioned along the path at selected locations, the scenery being viewable from the path;

display surfaces along the path at selected locations, the display surfaces being viewable from the path;

scenic images displayed on the display surfaces; and an environmental control system comprising an odor-inducing system for at least one path location, the odor-inducing system providing smells that complement the theme of the scenery and scenic images viewable from the at least one path location.

2. The system of claim 1, further comprising a walker care station.

3. The system of claim 2, wherein the walker care station comprises a physical information device.

4. The system of claim 3, wherein the physical information device measures the walker's heart rate.

5. The system of claim 3, wherein the physical information device measures the walker's temperature.

6. The system of claim 3, wherein the physical information device measures the walker's blood pressure.

7. The system of claim 3, wherein the physical information device measures the walker's weight.

8. The system of claim 3, wherein the physical information device measures the walker's calories burned.

9. The system of claim 2, wherein the walker care station comprises a walker information device.

10. The system of claim 9, wherein the walker information device provides the total distance the walker has walked.

11. The system of claim 9, wherein the walker information device provides the walker's average walking speed.

12. The system of claim 9, wherein the walker information device provides a comparison of the walk's current performance to the walker's prior walking performance.

13. The system of claim 9, wherein the walker information device provides a comparison of the walker's current performance to expected walking performance based on statistical norms.

14. The system of claim 9, wherein the walker information device provides information to the walker as to improvement of the walker's walking performance.

15. The system of claim 2, wherein the walker care station comprises a seating device.

16. The system of claim 2, wherein the walker care station comprises a reclining device.

17. The system of claim 2, wherein the walker care station comprises a beverage supply device.

18. The system of claim 2, wherein the walker care station comprises a beverage supply system.

19. The system of claim 1, wherein at least one location on the path is positioned with respect to the scenery and the scenic images such that the walker's view from the location is limited to the path, the scenery and the scenic images.

20. The system of claim 1, wherein the system further comprises at least two partitioned areas.

21. The system of claim 20, wherein the areas are connected by walking passageways.

22. The system of claim 21, wherein the path further comprising elevated sections, and wherein the passageways are elevated, the elevated passageways being accessed by the elevated path sections.

23. The system of claim 20, wherein at least two of the areas are partitioned by the display surfaces.

24. The system of claim 1, wherein the environmental control system further comprises an air filtration system.

25. The system of claim 1, wherein the environmental control system further comprises a temperature adjustment system for at least one path location, the temperature adjustment system providing temperatures that complement the theme of the scenery and scenic images viewable from the at least one path location.

26. The system of claim 1, wherein the environmental control system further comprises a sound-inducing system for at least one path location, the sound-inducing system providing temperatures that complement the theme of the scenery and scenic images viewable from the at least one path location.

27. The system of claim 1, wherein the scenic images include at least one image in motion.

28. The system of claim 1, wherein the scenic images include at least one fixed image.

29. The system of claim 1, wherein the scenic images include at least one digital image.

30. The system of claim 1, wherein the path further comprises movable path sections.

31. The system of claim 1, wherein the path further comprises at least one bridge.

32. The system of claim 1, wherein the path further comprises at least one tunnel.

33. The system of claim 1, wherein the path further comprises at least one incline.

34. The system of claim 1, wherein the path further comprises at least one decline.

35. The system of claim 1, wherein the path further comprises at least one set of steps.

36. The system of claim 1, wherein the path further comprises at least one slope.

37. The system of claim 1, wherein the path further comprises at least one rope ladder climb.

38. The system of claim 1, wherein the path further comprises at least one simulated rock wall climb.

39. The system of claim 1, wherein the path further comprises at least one simulated hill climb.

40. The system of claim 1, wherein the path further comprises at least two paths.

41. The system of claim 40, wherein each of the at least two paths further comprise indicia communicating the level of exertion required to complete the path.

42. The system of claim 1, wherein the path includes indicia communicating the level of exertion required to complete all or a portion of the path.

43. The system of claim 1, wherein the scenery is at least partially real.

44. The system of claim 1, wherein the scenery is at least partially artificial.

45. The system of claim 1, further comprising a ceiling.

46. The system of claim 45, wherein the ceiling is transparent.

47. The system of claim 1, wherein at least one of the display surfaces is a ceiling.

48. The system of claim 1, wherein the scenery further comprises at least one water pool.

49. The system of claim 1, wherein the scenery further comprises at least one artificial water pond.

50. The system of claim 1, wherein the scenery further comprises at least one artificial tree.

51. The system of claim 1, wherein the scenery further comprises at least one artificial shrub.

52. The system of claim 1, wherein the scenery further comprises at least one artificial plant.

53. The system of claim 1, wherein the scenery further comprises at least one artificial rock.

54. The system of claim 1, wherein the scenery further comprises at least one artificial grassy area.

55. The system of claim 1, wherein the scenery further comprises at least one artificial desert area.

56. The system of claim 1, wherein the scenery further comprises at least one artificial beach area.

57. The system of claim 1, wherein the scenery further comprises at least one artificial cactus.

58. The system of claim 1, wherein the scenery further comprises at least one recreated historical site.

59. The system of claim 1, wherein the scenery further comprises at least one recreated pre-historical site.

60. The system of claim 1, wherein the scenery further comprises at least one aquarium.

61. The system of claim 1, wherein the scenery further comprises at least one artificial rain forest area.

62. The system of claim 1, wherein the scenery further comprises at least one area having a holiday theme.

63. The system of claim 1, wherein the scenery further comprises at least one area having a seasonal theme.

64. The system of claim 1, wherein the scenery further comprises at least one area having a current events theme.

65. The system of claim 1, wherein the scenery further comprises at least one area having a theme depicting a city.

66. An indoor walking workout system, comprising:

a path adapted to be followed throughout the system; and means for thematically characterizing a location on the path.

67. The system of claim 66, wherein the means for thematically characterizing a location on the path further comprises:

scenery positioned along the path at selected locations, the scenery being viewable from the path; and means for displaying scenic images on display surfaces along the path at selected locations, the display surfaces being viewable from the path.

68. The system of claim 66, further comprising means for providing walker care at one or more locations along the path.

69. The system of claim 68, wherein the means for providing walker care comprises means for providing physical information about the walker.

70. The system of claim 68, wherein the means for providing walker care comprises a walker information device.

71. The system of claim 68, wherein the means for providing walker care comprises means for walker seating.

72. The system of claim 68, wherein the means for providing walker care comprises means for walker reclining.

73. The system of claim 68, wherein the means for providing walker care comprises means for supplying a beverage to the walker.

74. The system of claim 66, wherein the system further comprises means for partitioning the system into at least two areas.

75. The system of claim 74, wherein the areas are connected by walking passageways.

76. The system of claim 75, wherein at least one of the passageways is elevated, and further comprising means for providing access to the elevated passageways.

77. The system of claim 66, further comprising means for controlling the environment along the path.

78. The system of claim 77, wherein the environmental control system further comprises means for filtering the air.

79. The system of claim 77, wherein the environmental control system further comprises means for inducing an odor for at least one path location, the odors complementing the theme of the scenery and scenic images viewable from the at least one path location.

80. The system of claim 77, wherein the environmental control system further comprises means for adjusting the temperature for at least one path location, the temperature complementing the theme of the scenery and scenic images viewable from the at least one path location.

81. The system of claim 77, wherein the environmental control system further comprises means for inducing a sound for at least one path location, the sound complementing the theme of the scenery and scenic images viewable from the at least one path location.

* * * * *